US006109570A

United States Patent [19]

Heistand

[11] Patent Number: 6,109,570

[45] Date of Patent: Aug. 29, 2000

[54] SANDBAG FILLING STAND

[76] Inventor: Bryan T. Heistand, P.O. Box 57, Tracyton, Wash. 98393

[21] Appl. No.: 09/169,804

[22] Filed: Oct. 9, 1998

Related U.S. Application Data

[60] Provisional application No. 60/061,777, Oct. 10, 1997.

[51] Int. Cl.[7] ..... A63B 55/04

[52] U.S. Cl. ..... 248/97; 141/314

[58] Field of Search ..... 248/97, 99, 100, 248/101, 95, 98; 141/314, 391

[56] References Cited

U.S. PATENT DOCUMENTS

| | | | |
|---|---|---|---|
| 0,430,355 | 6/1890 | Stone . | |
| 0,534,278 | 2/1895 | Moon . | |
| 0,568,253 | 9/1896 | Howard . | |
| 1,431,726 | 10/1922 | Cupples . | |
| 1,456,175 | 5/1923 | Borlase . | |
| 1,637,131 | 7/1927 | Rigby . | |
| 4,044,921 | 8/1977 | Caverly | 222/74 |
| 4,467,845 | 8/1984 | Strand et al. | 141/314 X |
| 4,576,350 | 3/1986 | Bond | 248/97 |
| 5,056,571 | 10/1991 | Derby | 141/314 X |
| 5,095,960 | 3/1992 | Grundler et al. | 141/314 X |
| 5,215,127 | 6/1993 | Bergeron | 141/10 |
| 5,397,085 | 3/1995 | Spagnolo | 248/97 |
| 5,425,403 | 6/1995 | Herrmann | 141/314 |
| 5,523,519 | 6/1996 | Weber et al. | 141/314 X |
| 5,575,315 | 11/1996 | Wengert | 141/109 |

*Primary Examiner*—Ramon O. Ramirez
*Attorney, Agent, or Firm*—Frost & Jacobs LLP

[57] ABSTRACT

The sandbag filling stand is provided with a removable top section with at least one opening. This top section rests on side supports, typically, one at each end of the top section. A pivoting sandbag tray is under the top section and pivotally engages each side support. A rotating arm also pivotally engages each side support. With the rotating arm aligned in the vertical plane (up position), the sand tray is held roughly parallel to the ground on which the two side supports rest. When the rotating arm is pushed toward the sand tray pivot points, the sand tray will tilt. With the sand tray tilted at an angle any sandbag resting on the sand tray will tend to slide toward the low side of the tray for easy removal.

5 Claims, 1 Drawing Sheet

SANDBAG FILLING STAND

This application is based on U.S. Provisional patent Application Ser. No. 60/061,777, filed Oct. 10, 1997.

BACKGROUND OF THE INVENTION

1. Field of the Invention

The present invention relates generally to devices for holding bags, and more particularly, to devices used to hold a bag while filling it with sand or other material.

2. General Background

Sandbags are often the only flood control method available to reinforce or raise the height of dikes, berms, or levees used to protect property from flood water damage. The typical method used to fill sandbags is that one person holds the sandbag while a second person shovels sand or other granular material into the bag. When the bag is filled and the open end of the bag closed, the sandbag is ready for use. This method requires two people to fill a single sandbag at a time when there are generally insufficient personnel available to complete the work required to prevent or minimize flood damage. Additionally, as much as fifty percent of the sand thrown at a sandbag misses the bag, and falls back to the ground. The sand that misses the bag results in wasted effort. Thus, it takes a longer period of time to fill a sandbag and more energy is expended per sandbag. Consequently, fewer sandbags are filled in a given time period.

The prior art also provides portable methods and devices for filling sandbags. Two fairly recent examples of the prior art are U.S. Pat. No. 4,576,350 which issued on Mar. 18, 1986 to Bond, and U.S. Pat. No. 5,397,085 which issued on Mar. 14, 1995 to Spagnolo.

Bond illustrates a bag holder that attempts to address the above problems. The ability to hold two bags, one next to the other, or four in a cross shaped arrangement will somewhat reduce the quantity of sand that misses a bag. This arrangement, however, has only one side of each bag in common with other bags in the holder. Thus, even with this arrangement approximately thirty percent of the sand will miss one of the bags. The use of a single vertical support, may be acceptable for applications where the portable bag filling stand can be placed on a level surface. However, this system, it is believed, will experience reduced stability in actual field conditions where the stand will be placed on uneven surfaces and supporting sandbags weighing different amounts.

Spagnolo attempts to address the wasted effort caused by sand missing the bag by using a "fill chute" to direct approximately fifty percent of this sand into the bag. This bag holder, however, does not appear to be particularly stable on uneven ground. The lack of stability would be most noticeable when the sandbag is empty and/or the person filling the sandbag is shoveling heavy wet sand.

Accordingly, there exists a need for a sandbag filling stand which requires only one person to use, maximizes the amount of sand going into the bags, is easily stored, quickly assembled, sturdy enough for field use, and stable when used on uneven surfaces.

SUMMARY OF THE INVENTION

The present invention has solved the problems cited above, and comprises broadly a method and apparatus for holding sandbags while the sandbags are being filled. There is a removable top section with at least one opening. This top section typically rests on two side supports, one at each side of the top section. There is a sandbag tray that pivotally engages each side support. Typically these pivot points will be located along the rear edge of the tray. There is a rotating arm that also pivotally engages each side support. Typically, the rotating arm's pivot points will be located near the front of the side supports and below the horizontal plane of the pivot points of the sandbag tray. When the rotating arm is aligned in the vertical plane (up position), the sand tray is held roughly parallel to the ground on which the two side supports rest by the rotating arm. When the rotating arm is pushed toward the sand tray pivot points, the rotating arm will no longer support the sand tray. Without the support of the rotating arm the sand tray will pivot around its two pivot points, with either the front of the sand tray coming to rest on the ground or the sides of the tray resting on each side support. Consequently, the sand tray will be tilted at an angle and any sandbag resting solely on the sand tray will slide toward the front of the tray for easy removal.

BRIEF DESCRIPTION OF THE DRAWINGS

The accompanying drawing incorporated in and forming a part of the specification illustrates several aspects of the present invention, and together with the description serves to explain the principles of the invention. In the drawing.

Figure 1:
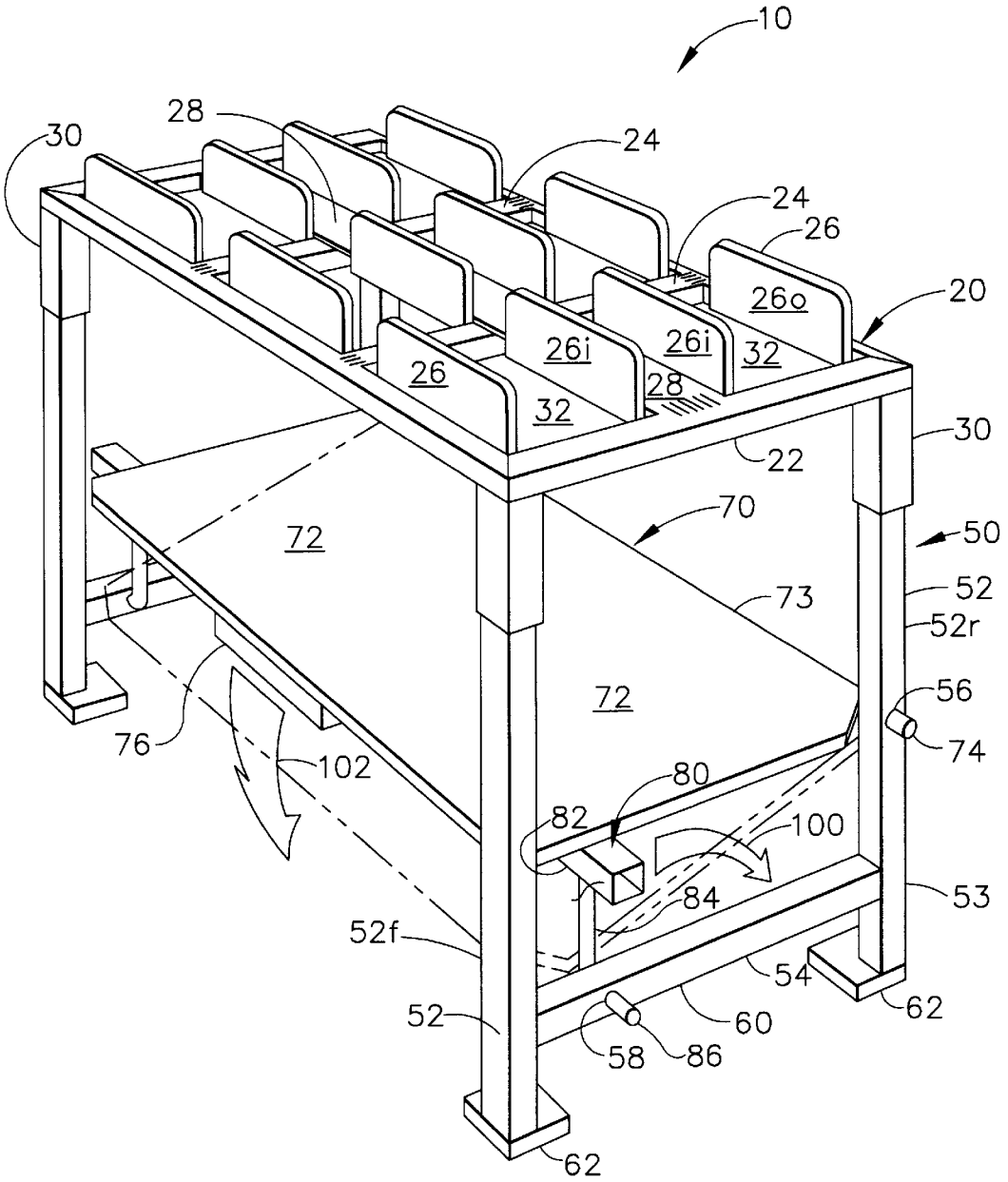
FIG. 1 is an isometric view the sandbag-filling stand of the present invention.

Reference will now be made in detail to the present preferred embodiment of the invention, examples of which are illustrated in the accompanying drawing.

DESCRIPTION OF THE PREFERRED EMBODIMENT

Description

FIG. 1 illustrates a sandbag-filling stand in accordance with the present invention. The sandbag-filling stand 10 has a removable top 20, side supports 50, a sand tray 70, and a rotating arm 80.

The stand 10 may be manufactured from any material that is tough and durable enough for use in field conditions and is strong enough to carry the weight of the desired number of full sandbags. Preferably stand 10 is manufactured from steel square tubing and thin steel plate or sheet metal. Aluminum or fiberglass/carbon fiber/kevlar composite tubing and plate may also be used. If these alternative materials are selected the stand 10 will be lighter in weight, but also will be somewhat less durable. The metal materials are typically welded together to form each piece. Each piece using composite materials may be molded as a single unit. Both the metal and composite materials may be bonded together with an adhesive or glue. However, if a bonding agent is utilized, care must be taken to select a glue or adhesive that will provide a tough, durable joint between the materials selected for stand 10.

Top 20 may be formed from frame 22, crosspieces 24, bag supports 26, spacers 28, and leg sockets 30. The frame 22 may be constructed from four lengths of square tubing. The actual length of this tubing will depend on the number of bags stand 10 is designed to hold. For the six bag stand 10 shown in FIG. 1 the tubing for each short side is approximately 17½ inches long with approximately a 45 degree angle cut at each end. The tubing for each long side is approximately 23⅜ inches long with approximately a 45 degree angle cut at each end. These four pieces are then assembled to form frame 22 as a rectangle by welding the corners. Crosspieces 24 may be joined to frame 22 if stand 10 has more than one column of bags. Crosspieces 24, if used, should be evenly spaced so that each bag opening 32 is approximately the same width. The six-bag stand 10 shown in FIG. 1 uses two crosspieces 24 to divide top 20 into three evenly spaced columns. The bag openings are arranged such that a sandbag will be proximate at least one other sand bag and preferably each sandbag is arranged such that the sandbag is proximate at least two other sand bags. This arrangement tends to reduce the amount of sand that misses a sandbag and falls back to the ground.

Spacers 28 may be used when there are more than one row of bag openings 32 in top 20. If installed, these spacers 28 may be cut from flat plate stock and joined to the frame 22 and crosspiece 24. The method of joining would depend on the materials selected. The crosspieces 24 and spacers 28 add rigidity to top 20 and aid in spreading the load from the sandbags to frame 22. Additionally, if spacers 28 are used, the spacers 28 could be joined to the inside bag supports **26*i*** to provide additional structural support.

Bag supports 26, if used, are typically cut from ⅛ inch thick steel plate and welded to the frame 22 and to crosspiece 24. If spacers 28 are used, then bag supports 26 could also be welded to spacers 28 for added strength. Bag supports 26 are generally rectangular in shape with the corners above the frame 22 typically rounded to reduce the chance of tearing the sand bag, and to increase the ease of installing and removing sand bags. The width of the bag supports 26 is typically the same as the width of bag opening 32. The size of opening 32 is designed to fit a "standard" sandbag (approximately 6 to 7 inches wide and approximately 6 to 7 inches deep). The height of the bag supports is typically 2 to 3 inches. This height provides an unfilled section of the sandbag of sufficient length to permit the sandbag to be securely closed while the sandbag resides in stand 10.

Leg sockets 30 may be jointed to frame 22 at each corner. These sockets 30 are typically formed from square tubing whose interior dimensions are slightly larger than the exterior dimensions of the square tubing used in the side supports 50. Consequently, the side supports 50 can be inserted into and removed from leg sockets 30 allowing the stand 10 to be easily assembled and disassembled. Additionally, it is preferred that leg sockets 30 are located at the corners of frame 22 such that side support 50, when the side support 50 is removed from top 20, will lay on top 20 proximate to frame 22. This spacing of leg sockets 30 permits the stand 10 to occupy a smaller volume when stored and transported.

Stand 10 typically has two side supports 50, one located on each end of stand 10. The side supports 50 typically have legs 52, crossbar 54, sand tray pivot opening 56, a rotating arm pivot opening 58, and foot pads 62. The legs 52 slide into leg sockets 30 and support the weight of top 20. Each leg 52 has a lower end 53 where crossbar 54 may be joined to leg 52. The length of legs 52 is preferred to be about 20–26 inches. The length of legs 52 is selected based on the height of the sand bag when filed, taking into account the length of the sandbag that is doubled over bag support 26, and the additional height added so that sand tray 70 will pivot to discharge the sandbags. The length of crossbar 54 is preferably selected such that side support 50 can lay on top 20 with legs 52 proximate to frame 22. This distance will be slightly larger than the distance between the outside surfaces of outside bag supports **26*o*. When assembled, side support 50 may look like an "H" with short lower legs. The legs 52 and crossbar 54 are generally manufactured from the same materials and joined in a similar manner as the frame 22 described above. Additionally, a foot pad 62 may be joined to a bottom end of each leg 52. Pad 62 is preferably cut from 1/16 inch steel sheet metal and welded to the bottom end of leg 52. The use of a foot pad 62, while optional, helps to prevent stand 10 from sinking into soft soils. The rear leg 52*r* may have a sand tray pivot opening 56 drilled through the leg 52*r*. This opening 56 allows the sand tray 70 to pivot and the sandbags contained on the tray 70 to slide to the front of stand 10 for removal. Sand tray pivot opening 56 is located at the proper distance below an upper end of leg 52 so that sand tray 70 can support the sandbags draped over bag support 26 and such that when the sandbags are full the sand tray 70 can pivot to discharge the sandbags. This distance is typically about 14 inches from the upper end of leg 52. Crossbar 54 may have a rotating arm pivot opening 58 located in the forward half 60 of crossbar 54. Typically, this opening 58 is located between ⅕ and ¼ of the length of crossbar 54. This distance is measured from the joint between crossbar 54 and a front leg 52*f*. The rotating arm pivot opening 58 may be drilled all the way through the crossbar 54 or only through the inner wall of the crossbar 54. This opening 58 allows the rotating arm 80 to rotate around an arc 100**.

Sand tray 70 resides under top 20 and between side supports 50. Sand tray 70 typically includes sand table 72, rear support (not shown), thumb screw 74, and arm stop 76. Sand table 72 is generally rectangular in shape. Preferably, the exterior dimensions of the table 72 will be the same as the exterior dimensions of frame 22. The corners of table 72 may be removed so that table 72 will not contact legs 52 when the sand tray 70 is positioned between side supports 50. Sand table 72 can be manufactured from any flat plate having sufficient strength to carry the number of sandbags that stand 10 is designed to hold. Preferably, table 72 is cut from 1/16 inch steel sheet metal. Sand table 72 has a rear edge 73 that is joined to the rear support.

The rear support provides support for sand table 72 along rear edge 73. The rear support is typically manufactured from the same material as legs 52 and frame 22. The sand table 72 is joined to the rear support by any means compatible with the materials selected for table 72 and the rear support, and has sufficient strength and durability for use under field conditions. Preferably, sand table 72 will be welded to the rear support. Each end of the rear support is sealed with a threaded nut (not shown). Typically, this nut will be welded to the rear support. Thumb screw 74 is fastened to each end of the rear support using the threaded nut. Each thumb screw 74 slidably engages sand tray pivot opening 56 and fastens to the rear support, forming a hinge whereby sand tray 70 can pivot in sand tray pivot opening 56.

Near the front of sand table 72 may be arm stop 76. Arm stop 76, if used, is typically formed from the same material as the rear support and is joined to table 72 in the same fashion as the rear support. The arm stop 76 is generally centered between the side supports 50. Preferably, arm stop 76 is relativity short, about 2 inches in length. However, in some embodiments arm stop 76 may be longer and even extend across the entire width of sand table 72. A longer arm stop 76 may be required when table 72 is manufactured from a material other than 1/16 inch steel sheet metal. Typically, arm stop 76 is located about ⅕ to ¼ of the depth of table 72 from a front edge of table 72. The exact placement of arm stop 76 will depend on the exact location of the rotating arm 80 and the rotating arm pivot opening 58 in crossbar 54. Arm stop 76 should be positioned so that rotating arm 80 will form approximately a 90 degree angle with crossbar 54 when rotating arm 80 makes contact with arm stop 76. This angle would be only measured after rotating arm 80 has been rotated from the lowered position to the vertical position by pulling the rotating arm towards the front of the stand 10.

Rotating arm 80 supports the front portion of sand tray 70 when rotating arm 80 is in the vertical position. When rotating arm 80 is in the vertical position as shown in FIG. 1 the sand tray 70 is approximately level and parallel to top 20 and crossbar 54. When rotating arm 80 is pushed toward the rear of stand 10 arm 80 will no longer support the front of sand tray 70. Consequently, rotating arm 80 will rotate around rotating arm pivot opening 58 and rest on crossbar 54. Simultaneously, sand tray 70 will pivot in sand tray pivot opening 56 and the front edge of the sand table 72 will fall until the edges of the sand table 72 are supported by crossbar 54 or the front edge of sand table 72 rests on the ground. Thus, the sand tray 70 will now be inclined so that the sandbags resting on the sand tray 70 will slide to the front of stand 10.

Rotating arm 80 includes support bar 82 and L round bar 84. Support bar 82 is typically formed from the same material as legs 52 and frame 22. Bar 82 is usually a square tube but in most applications round tube will also be suitable. Bar 82 will typically be the same size as the back support for sand tray 70 since these support pieces both carry approximately the same load. Joined to support bar 82 is L round bar 84. L round bar 84 is preferably a steel rod of the appropriate length bent into an "L" shape. Typically, L round bar 84 is welded to support bar 82 near each end of support bar 82. The length of L round bar 84 is selected so that rotating arm 80 can hold sand tray 70 approximately parallel to frame 22 and crossbar 54 when the rotating arm 80 is in the approximately vertical position. The short end 86 of the L round bar 84 slidably engages the rotating arm pivot opening 58. This opening 58 permits the rotating arm 80 to rotate around the short end 86 and rotating arm pivot opening 58. Preferably, support bar 82 will project beyond the joint with L round bar 84 at least 4 inches. This portion of the support bar 84 will be used as an operating handle for rotating arm 80.

Assembly

First, top 20 is placed upside down on the ground. Next, side supports 50 are set into top 20 by sliding legs 52 into leg sockets 30. Then, each short end 86 of the rotating arm 80 is inserted into each rotating arm pivot opening 58 in crossbar 54. Stand 10 is rotated to the upright position while holding side supports 50 together. The side supports 50 are held together so that rotating arm 80 does not fall out. Sand tray 70 with the thumb screws 74 removed is slid between side supports and between top 20 and rotating arm 80. Once the sand tray 70 is in place, the sand tray 70 is rested on the rotating arm 80, with rotating arm 80 in the approximately vertical position and the support bar 82 behind arm stop 76. Then thumb screws 74 are inserted through the sand tray pivot opening 56 in leg 52*r* and threaded into the nut in each end of the rear support of sand tray 70. The thumb screws 74 are tightened snug. With thumbscrews 74 snug, the stand 10 is fastened together such that the sand tray 70 will pivot in sand tray pivot openings 56. Once stand 10 is fastened together, the stand 10 may be moved and used without any special precautions. When stand 10 is no longer being used to fill sandbags, the above process is reversed to disassemble the sandbag filling stand 10.

Use

The sand filling stand 10 is used by first selecting an area close to a sand pile to assemble the stand 10. Then, the stand 10 is assembled as described above. After a sandbag is placed in its bag opening 32, the upper 2 to 4 inches of the bag is folded over the bag supports 26*o* and 26*i* for that particular bag opening 32 on top 20. After the desired number of sandbags has been loaded into stand 10, the sandbags are filled with sand. For the purpose of this application sand is defined to include sand, gravel, dirt, topsoil, aggregate, concrete, cement or any other granular material. When the sandbags are full, the upper portion of the sandbag is unfolded from over bag support 26. Next, each sandbag is securely closed so that the contents will not easily spill. After all the sandbags in stand 10 are closed, the rotating arm 80 is pushed toward the rear of stand 10 as shown by rotation arrow 100. Typically, rotating arm 80 is moved by kicking the handle portion of support bar 82 that projects beyond the edge of sand tray 70. This movement of rotating arm 80 will remove the support provided by support bar 82. Consequently, sand tray 70 will pivot on thumb screws 74 in sand tray pivot openings 56. This motion of sand tray 70 is shown by pivot arrow 102. After sand tray 70 falls to its inclined position (shown in dashed lines on FIG. 1), the sandbags will slide to the front of the sandbag-filling stand 10 for collection and use.

In summary, numerous benefits have been described which result from employing the concepts of the present invention. The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

What is claimed is:

1. A sandbag filling stand comprising:

a top section, said top section having an opening for at least one sandbag;

side supports, said top section supported by said side supports;

a sand tray, said sand tray is located below said top section, said sand tray is pivotally connected to said side supports, and said sand tray adapted to support said at least one sandbag; and a rotating arm, said arm pivotally connected to said side supports, said arm supporting said sand tray when said arm is in a first position, and permitting said sand tray to tilt away from said top section when said arm is pivoted to a second position.

2. The sandbag filling stand of claim 1 where said opening adapted to accept at least one sandbag is a plurality of openings adapted to accept at least one sandbag each.

3. The sandbag filling stand of claim 2 where said plurality of openings are arranged so that each opening of said plurality of openings has at least one other opening of said plurality of openings proximate thereto.

4. The sandbag filling stand of claim 2 where said plurality of openings are arranged so that each opening of said plurality of openings has at least two other openings of said plurality of openings proximate thereto.

5. The sandbag filling stand of claim 2 where said top section further comprises at least two bag supports adapted for supporting at least one sandbag, within each opening of said plurality of openings.

* * * * *